United States Patent [19]

Clement, Jr.

[11] 4,118,824

[45] Oct. 10, 1978

[54] APPLICATOR HAVING INSERTABLE SPONGE CARTRIDGE

[76] Inventor: Paul Santas Clement, Jr., 5940 Wentworth St., Long Beach, Calif. 90815

[21] Appl. No.: 809,754

[22] Filed: Jun. 24, 1977

[51] Int. Cl.[2] ..... A47K 7/02

[52] U.S. Cl. ..... 15/244 R; 15/176

[58] Field of Search ..... 15/104.94, 176, 210 A, 15/231, 244 R; 401/18, 23.25, 207; 128/269

[56] References Cited

U.S. PATENT DOCUMENTS

| | | | |
|---|---|---|---|
| 2,647,273 | 8/1953 | Eagle | 15/244 R X |
| 2,715,237 | 8/1955 | Trindl | 15/244 R |
| 3,369,474 | 2/1968 | Callaghan | 15/104.94 X |
| 3,897,603 | 8/1975 | Brennenstuhl | 15/244 R |

FOREIGN PATENT DOCUMENTS

| | | | |
|---|---|---|---|
| 421,460 | 12/1934 | United Kingdom | 15/244 R |

*Primary Examiner*—Daniel Blum

*Attorney, Agent, or Firm*—I. Michael Bak-Boychuk

[57] ABSTRACT

A lotion applicator comprising a handle terminating in a mount supporting a sponge is disclosed herein. The mount is removable from the handle for alternative direct manual grasping. In addition, the sponge itself is secured to a channel support segment which is conformed for sidewise translation over the mount. The handle itself includes, a lateral recess conformed to accept the mount with the sponge mounted thereon. To aid in the withdrawal of the mount and thus to facilitate renewal of the sponge, the mount itself includes a planar projection which extends on the distal side of the handle to provide a grasping surface for manipulative convenience. The support segment, shaped in a manner of a thin-walled channel, includes V-shaped side walls, the apex of each V-shaped side wall being directed towards the interior of the channel to thus provide a reduced dimension between the channel walls. The mount is similarly shaped for telescopic receipt within the support segment, said mount further including rounded pins at various locations thereof which are conformed for receipt in corresponding openings in the support channel. The recess in the handle is, in turn, conformed to the exterior dimensions of the lateral channel surfaces and will thus maintain the support channel on the mount upon insertion therein.

3 Claims, 6 Drawing Figures

FIG. 1
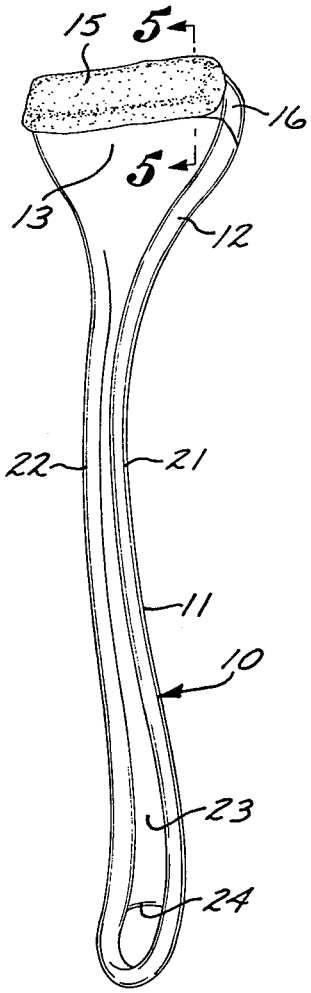
FIG. 2
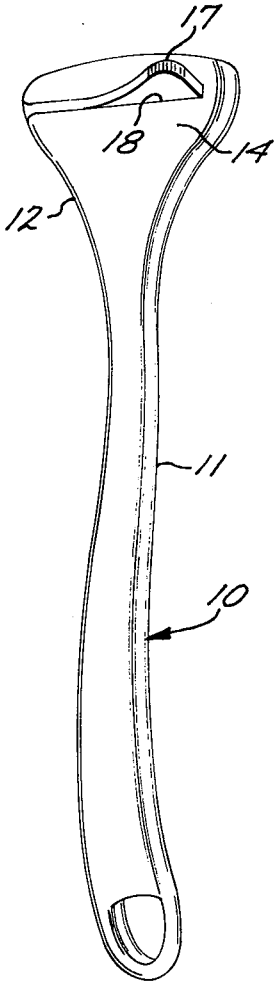
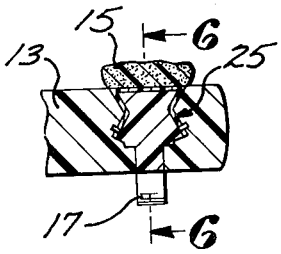
FIG. 5
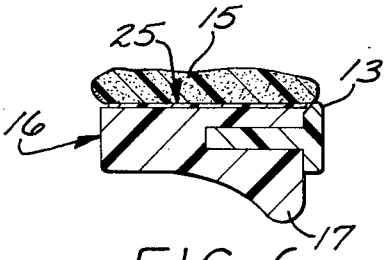
FIG. 6
FIG. 3
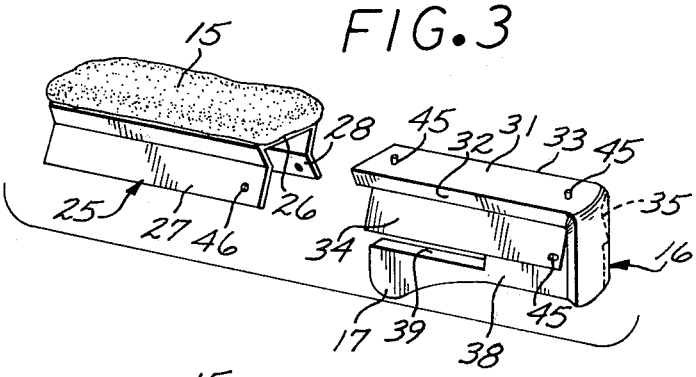
FIG. 4
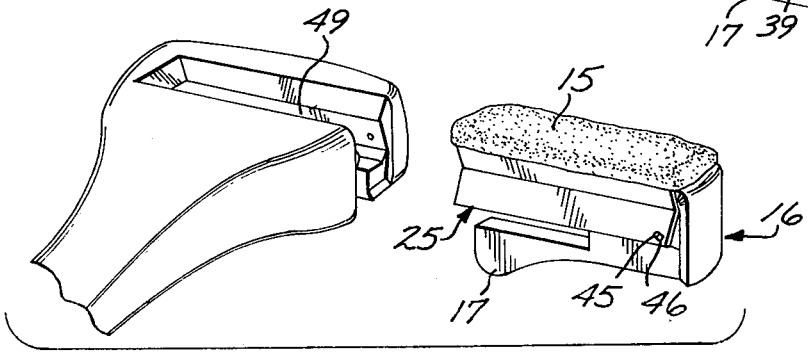

APPLICATOR HAVING INSERTABLE SPONGE CARTRIDGE

BACKGROUND OF THE INVENTION

1. Field of the Invention

The present invention relates to lotion applicators, more particularly to a lotion applicator having a removable head which is conformed for alternative manual grasping.

2. Description of the Prior Art

In the past the various applicators have been developed by which areas inaccessible normally can be swabbed or cleansed. More specifically, the back of a person is normally difficult to reach and is therefore infrequently cleansed or cared for. In many instances skin conditions require certain frequency of cleansing or medical application and for these purposes the prior art devices have been developed. Most typically such prior art devices permanently affix the sponge, or the other applicating medium, to the handle and thus upon the eventual wear and deterioration of the sponge, the whole implement must be discarded. Alternatively, there have been some devices developed previously where the sponge itself is removable from the handle. In those instances the adhesion of the sponge to the handle requires elaborate techniques, often in the form of glue or other adhesive, and sometimes by way of stretched fit. In each instance, the installation and removal process is quite complex and because of that use of applicators of this kind have had less than prevailing acceptance in the market. Furthermore, in each instance the prior art devices are conformed in such a manner that the sponge, once separated, lacks the necessary structural stiffness for use as a manually grasped device.

These inconveniences, and in particular, the inconvenience of removal and refitting furthermore dictate that the prior art applicators be used for a single purpose. Very often application of the various medications or lotions are not compatible with the detergent retained in the sponge during the process of bathing. Thus, quite often a plural set of applicators is necessary in order to accommodate various uses contemplated. This duplication in the handle structure, and the inconvenience of removing the sponge, all entail excess cost to the user and furthermore comprise an unnecessary waste of resources.

SUMMARY OF THE INVENTION

Accordingly, it is the general purpose and object of the present invention to provide an applicator structure including a removable mount, the mount being further conformed for direct manipulative use.

Further objects of the invention are to provide an applicator structure wherein the mount and the handle interface provide a secure interlock for attaching the applicator sponge.

Yet further objects of the invention are to provide an applicator structure wherein the applicator sponge is removed as a cartridge.

Yet additional objects of the invention are to provide an applicator structure which is convenient to use, simple to renew, and requires few parts.

Briefly these other objects are accomplished within the present invention by providing a handle, formed of a material like plastic, said handle terminating in a head structure provided with a lateral recess. Received within this recess is a mount assembly comprising an insertable mount having secured thereto in telescopic engagement a sponge cartridge. The lateral recess in the handle is conformed to slidably receive the mount and the sponge cartridge, the interface therebetween being such as to provide an interlock whereby the sponge is securely attached. The sponge structure includes a sponge mounted on the center surface of a metallic channel, the side walls of the channel being convolved in the manner of a V, the points of the V being inwardly directed towards the interior of the channel to form a reduced dimension therebetween. The mount itself is conformed to provide a surface laterally insertable into this channel, the mount further including disposed at various points thereof, a plurality of rounded pins. It is these pins that are received within a corresponding set of openings in the channel structure to mount and retain the sponge cartridge thereon.

In this manner various sponge cartridges may be utilized, each dedicated to a particular purpose, and furthermore, cartridge interchange may be conveniently achieved as the sponges wear out.

BRIEF DESCRIPTION OF THE DRAWINGS

FIG. 1 is a perspective illustration of the inventive applicator arranged to expose the frontal side thereof;

FIG. 2 is yet another perspective illustration of the same applicator shown in FIG. 1, the arrangement in FIG. 2 being such as to expose the rear thereof;

FIG. 3 is a perspective exploded illustration of a sponge cartridge useful with the invention herein;

FIG. 4 is an illustration, in perspective view of a mount formed to receive the cartridge shown in FIG. 3;

FIG. 5 is a cross-section taken along line 5—5 of FIG. 1; and

FIG. 6 is a cross-sectional view taken along line 6—6 of FIG. 5.

DESCRIPTION OF THE SPECIFIC EMBODIMENT

As shown in FIGS. 1 and 2 the inventive applicator, generally designated by the numeral 10 comprises an elongated handle 11 terminating in a bulbous head 12 having a front and rear face respectively designated as face 13 and 14. Disposed on face 13, proximate the upper end of the applicator 10, is an elongate traversely aligned strip of open-celled sponge material 15 which may be utilized to either dispense lotion or detergents over the body surface of the user. The foam strip 15, in turn, is mounted on an insertable mount 16 conformed for lateral insertion into the bulbous head 12. On the other side, mount 16 extends in a manner of a planar tab 17 projecting through a slot 18 formed in the rear face 14. In this form the extended handle 11 provides the necessary manipulative features for extending the reach of the user and thus allows application of any liquid desired to the previously unreachable portion of the body. To provide the necessary rigidity with the minimum of material used, handle 11 is conformed in a section to approximate an "I beam" or channel, and thus includes two lateral beads 21 and 22 joined by a center web 23. This structural form increases the sectional moment of inertia and therefore increases the bending strength of the handle. Furthermore, in order to facilitate storage, the other extreme of handle 11 is provided with an opening 24 which is useful in engaging pegs or similar suspending devices.

As shown in FIGS. 3–6, the configuration of head 12 and the mount 16 allows for convenient replacement of the sponge strip 15, and furthermore permits the use of the sponge 15 in secured arrangement on the mount independent of the handle. More specifically, sponge 15 is conformed in a manner of a cartridge comprising an underlying sheet metal channel segment 25 formed to include a center web 26 bound by two lateral edge surfaces 27 and 28 respectively. It is on the exterior of web 26 that the sponge 15 is secured by any adhesive method. The sponge 15 and the segment 25 thus form a unitary cartridge for convenient replacement.

To secure this cartridge to mount 16 the side walls 27 and 28 are, furthermore, convolved in a manner V, the apex of each V being directed towards the interior of the channel. Mount 16 is similarly conformed for interior receipt within the channel segment 25 and therefore includes a spine segment 31 having side edges 32 and 33 respectively formed on an inward taper, the dimension of the spine being sized to the interior dimension of the center web 26. Extending below the side edges 32 and 33 are two lateral surfaces 34 and 35 respectively, surfaces 34 and 35 being inclined on an outward taper. Edges 32 and 33 and surfaces 34 and 35 thus form, once more, a V-shaped convolution approximating the interior surface of the side walls 27 and 28.

Extending below the surfaces 33, 34 and 35 in a plane substantially orthogonal to the plane of the spine 31 is yet another web 38, transversely conformed for receipt within the aforementioned slot 18 in the head 12. Web 38 includes a lateral cut-out 39 conformed to receive the surface in head 12 at the end of the slot 18 and terminates in the aforemehtioned tab 17 to facilitate withdrawal.

These features provide for an interlocking arrangement of parts whereby retention of mount 16 into the interior of the head 12 is rendered possible.

To further secure the channel segment 25 to the exterior of mount 16, it is contemplated to provide a plurality of rounded pins 45 standing proudly beyond the surfaces of spine 31 and the lateral surfaces 34 and 35, the channel segment 25 being provided with a corresponding set of openings 46 receiving these pins. These same pins 45 extend beyond the surfaces of segment 45 to engage a plurality of recessed dimples, as seen in FIG. 4, on the interior of the head 12.

As shown in FIG. 6 the front surface 13 of head 12 includes yet another cut-out 49. Cut-out 49 including lateral interior surfaces similarly conformed on a V and dimensioned to mate with the exterior surfaces of the side webs 27 and 28, surfaces 50 including the aforementioned dimples for retaining the pins.

By way of the foregoing arrangement of parts, a device which is conveniently assembled is set out, the features of the device further providing the manipulative advantage of utilizing the mount 16 as an independent tool by which direct sponge application can be made.

Obviously many modifications and variations to the above disclosure can be made without departing from the spirit of the invention. It is therefore intended that the scope of the invention be determined solely dependent on the claims hereto.

I claim:

1. An applicator comprising:

a handle having a lower segment conformed for manual grasping and an upper segment conformed as an enlarged head, said upper segment including a lateral slot partly extending thereacross;

a mount conformed for telescopic insertion into said lateral slot;

a sponge cartridge including an elongate strip of sponge material attached to a thin-walled support conformed for interposed fit between said slot and said mount;

said slot including convolved interior surfaces and said mount including exterior surfaces conforming to the convolutions of said interior surfaces in said slot, said support being convolved in section for interspaced receipt between said interior and exterior surfaces; and said interior and exterior surfaces each being convolved to include opposing V-shaped walls, said interior surfaces having the apex of the V conformed for sliding receipt in said mount.

2. Apparatus according to claim 1 wherein:

said mount includes a plurality of cylindrical projections disposed on said exterior surfaces thereof; and said support includes a plurality of openings arranged for concurrent receipt of said projections; and said slot includes a plurality of recesses conformed to receive said projections extending beyond said support.

3. Apparatus according to claim 2 wherein:

said mount and handle are made of plastic.

* * * * *